US011735135B2

(12) United States Patent
Chen

(10) Patent No.: US 11,735,135 B2
(45) Date of Patent: Aug. 22, 2023

(54) SCREEN FLICKER PERFORMANCE MANAGER

(71) Applicant: Microsoft Technology Licensing, LLC, Redmond, WA (US)

(72) Inventor: Guo Sheng Chen, Taipei (TW)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 17/333,157

(22) Filed: May 28, 2021

(65) Prior Publication Data

US 2022/0383833 A1 Dec. 1, 2022

(51) Int. Cl.
*G09G 3/36* (2006.01)

(52) U.S. Cl.
CPC ..... *G09G 3/3696* (2013.01); *G09G 2310/08* (2013.01); *G09G 2320/0247* (2013.01)

(58) Field of Classification Search
CPC .. G09G 3/3648; G09G 3/3614; G09G 3/3655; G09G 3/3688; G09G 2300/0426
See application file for complete search history.

(56) References Cited

U.S. PATENT DOCUMENTS 5,963,156 A * 10/1999 Lewicki ..... H03F 3/45986 341/122
10,540,939 B2 * 1/2020 Seo ..... G09G 3/3696
2009/0040841 A1 * 2/2009 Richter ..... G11C 16/10 365/189.16
2011/0205212 A1 * 8/2011 Matsumoto ..... G09G 3/3677 345/211
2015/0123883 A1 * 5/2015 Lin ..... G09G 3/3233 345/76
2016/0013955 A1 * 1/2016 Dong ..... H04L 25/03019 375/317
2016/0155404 A1 * 6/2016 Kim ..... G09G 3/3659 345/205
2017/0148369 A1 * 5/2017 Park ..... G09G 3/2007
2018/0350283 A1 12/2018 Jiang et al.
2019/0006020 A1 * 1/2019 Sundaresan ..... G11C 29/12005
2020/0302866 A1 * 9/2020 Kim ..... G09G 3/2014
2021/0174922 A1 * 6/2021 Noro ..... A61B 6/032
2021/0241666 A1 * 8/2021 Gupta ..... G06F 1/1694
2022/0044614 A1 * 2/2022 Yun ..... G06F 1/1677

OTHER PUBLICATIONS

"International Search Report and Written Opinion Issued in PCT Application No. PCT/US22/027560", dated Jul. 22, 2022, 11 Pages.

* cited by examiner

*Primary Examiner* — Van N Chow
(74) *Attorney, Agent, or Firm* — Holzer Patel Drennan

(57) ABSTRACT

The flicker performance manager disclosed herein implements a method including measuring a liquid crystal (LC) common voltage (VCOM) over a predetermined period of operation an LCD panel having a plurality of LCs, determining a shift in the VCOM (VCOM shift) over the predetermined period based at least in part on the measured VCO, storing the VCOM shift as a function of time in a table of an embedded controller, receiving a power-on signal for the LCD panel and adjusting a VCOM reference level applied to the LCs based at least in part on the stored values of the VCOM shift.

19 Claims, 5 Drawing Sheets

SCREEN FLICKER PERFORMANCE MANAGER

BACKGROUND

Modern computing devices use displays to present information to users as well as to receive input from the users. Common examples of displays are liquid crystal displays (LCDs). LCDs work by blocking light. Specifically, an LCD is made of two pieces of polarized glass, also called substrate, that contain a liquid crystal material between them. A backlight creates light that passes through the first substrate.

SUMMARY

The flicker performance manager disclosed herein implements a method including measuring a liquid crystal (LC) common voltage (VCOM) over a predetermined period of operation an LCD panel having a plurality of LCs, determining a shift in the VCOM (VCOM shift) over the predetermined period based at least in part on the measured VCOM, storing the VCOM shift as a function of time in a table of an embedded controller, receiving a power-on signal for the LCD panel and adjusting a VCOM reference level applied to the LCs based at least in part on the stored values of the VCOM shift.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Other implementations are also described and recited herein.

BRIEF DESCRIPTIONS OF THE DRAWINGS

In order to describe the technical solutions in the embodiments of the present disclosure more clearly, the drawings required to be used for descriptions about the implementations are introduced below. It is apparent that the drawings described below are only some implementations of the present disclosure.

DETAILED DESCRIPTIONS

Figure 1:
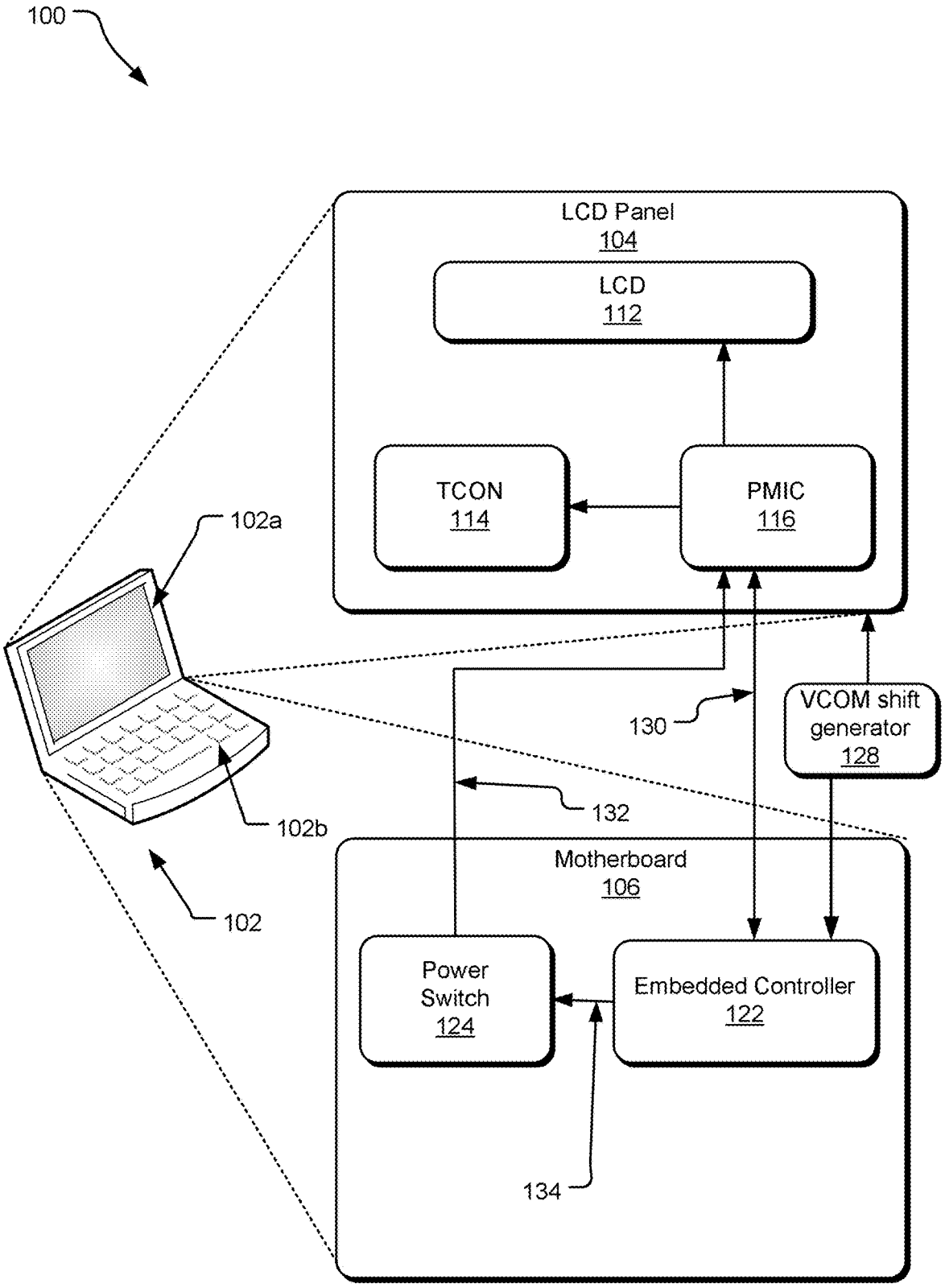
FIG. 1 illustrates an example block diagram of a screen flicker management system disclosed herein.

A liquid-crystal display (LCD) is a flat-panel display or other electronically modulated optical device that uses the light-modulating properties of liquid crystals (LCs) combined with polarizers. To prevent LCs from accumulating DC charges, the LCs are driven by alternating positive and negative voltage frames. However, such inversion of positive and negative voltages results in the LCD to flicker. For example, human eyes are sensitive to flicker of approximately −50 dB or higher for gray 127 pattern and similarly, different flicker levels when other patterns are used.

However, as the LCDs age, electronic charge trapping between thin film transistor (TFT) layer of LCs causes the common electrode voltage (VCOM) for the LC to shift. Adjustment to the VCOM is a commonly used method to minimize charge accumulation and to balance positive and negative voltages. Specifically, VCOM is adjusted so that it is at the center of the voltage levels of the positive frame and the negative frame applied to the LCs. Along with aging of liquid crystals, accumulation of static electricity and the like, a screen flickering phenomenon is likely to occur to an LCD screen. Such a screen flickering phenomenon may be quite serious and visible to naked eyes sometimes. Specifically, after the screen is used for a long time, such a slight screen flickering phenomenon, may also harm the eyes of a user and bring poor user experiences.

As lower refresh rate is deployed for computing products to reduce panel power consumption, the flicker rate becomes more critical. Specifically, at low refresh rates, human eyes are more sensitive to flicker. Furthermore, flicker performance worsens during operation of displays due to VCOM shift, leading visible flicker at low refresh rate. The technology disclosed herein minimizes the user impact of flicker by implementing a flicker management program and a table storing VCOM shift as function of time on an embedded controller on a motherboard. The embedded controller may determine VCOM adjustments using the flicker management program and communicate via an I2C interface to an LCD panel to dynamically adjust VCOM levels.

The technology disclosed herein solves a technical problem of managing flicker in a display screen. Specifically, the technology disclosed herein uses the common reference voltage applied to the LCs, referred to as VCOM, and the shift of the VCOM to reduce the flicker in display screens. In one implementation, an embedded controller determines adjustment to the VCOM to be applied to the LCs based at least in part on VCOM shift during rolling time period lapsed from receiving a power-on signal for the display screen.

The screen flicker management system disclosed herein also provides technical advantage in that it allows operating display screens at lower refresh rates due to the lower flicker rates. For example, after deploying the screen flicker management system disclosed herein, screen refresh rates can be reduced to as low at 30 Hz without increase in the flicker rate. Such low refresh rates also reduces the power consumption by the display screen. Furthermore, the screen flicker management system disclosed herein allows flicker management to be applied by dynamically tuning VCOM irrespective of the display panel vendor, thus removing dependency on display panel manufacturer suggested flicker management solutions.

Furthermore, allowing the embedded controller to dynamically adjust the VCOM levels provides technically better functioning of the LCD panel throughout the entire lifecycle of the LCD panel. Specifically, such dynamic adjustments of the VCO levels, communicated by the embedded controller to the LCD panel via an I2C interface, can be easily implemented by a power management integrated circuit (PMIC) of the LCD panel such that during each stage of the lifecycle of the LCD, the VCOM level is set to reduce the flicker. Moreover, as the VCOM adjustments are determined based on rolling time period lapsed from receiving a power-on signal for the display screen, the expected flicker levels for each of such time periods, in view of the expected VCOM shift during such rolling time periods, are minimized. As an example, if the VCOM shift during the rolling four-hour period at eight hours after the power ON is expected to be substantially lower, determining the adjustment to be applied to the VCOM to be lower results in reduced flicker during this time period.

FIG. 1 illustrates a block diagram of a screen flicker management system 100 disclosed herein. Specifically, the screen flicker management system 100 illustrates a computing device 102 including a display 102*a* that is communicatively attached to a keyboard 102*b* implemented on a motherboard 106 of the computing device 102. Note that while in the illustrated implementation, the computing device 102 is illustrated as being a laptop device, in alternative implementations, it may be a desktop, a tablet, a mobile phone, etc. Furthermore, while the computing device 102 has only one display 102*a*, in alternative implementations, it may have two displays.

The display 102*a* may include an LCD panel 104 that includes, among other components, an LCD 112, a timing controller (TCON) 114, and a power management integrated circuit (PMIC) 116. The LCD 112 may include two display panels provided with pixel electrodes and a common electrode and an LC layer having dielectric anisotropy and interposed between the two panels. The pixel electrodes are arranged in a matrix format and are connected to a switch such as a thin film transistor (TFT) to sequentially receive a data voltage by row. The common electrode is formed over the entire surface of the display panel to receive a common voltage (VCOM). The pixel electrodes, the common electrode, and the LC layer interposed between the pixel electrodes and the common electrode form a liquid crystal capacitor, and the liquid crystal capacitor and a switch connected thereto become a basic unit forming a pixel.

The TCON 114 may control the timing of the pixels the LCD panel 104. The TCON 114 may control the timing of scan signals and data voltage, and the VCOM applied to the LCD 112 during a data writing period operation of the LCD 112. The TCON 114 may receive power from the PMIC 116.

The motherboard 106 may include, among other components, an embedded controller 122 and a power switch 124. The power switch 124 may be an NMOS switch or a PMOS switch that receives control signal from the embedded controller 122. The embedded controller 122 maybe a combination of a hardware, firmware, and software instructions stored on ROM thereon. For example, an implementation of the embedded controller 122 may include a CPU, ROM storing various computing instructions that may be executed on the CPU, as well as data.

The screen flicker management system 100 also includes a VCOM shift generator 128 that may be implemented using computing instructions executable on a processor. The VCOM shift generator 128 may measure VCOM of the LCs on the LCD 112 over a predetermined time period and records the measured values. For example, the VCOM shift generator 128 may operate the LCD panel for a twenty-four (24) hour on period followed by a six (6) hours of off period and record the VCOM levels of the LCs. The VCOM shift generator 128 may store the measured VCOM levels in local memory and calculate rolling averages for various time-periods, such as rolling a two-hour time period, a rolling four hour time period, a rolling 24-hour time period after power ON as well as various rolling time periods during the off stage. These averages may be stored in a table in the embedded controller 122. As further illustrated below in FIG. 4, the VCOM shift depends on the time-period after a power ON of the LCD panel. For example, the VCOM shift during the first two hour period is higher than the VCOM shift between 8 and 24 hours after power ON. By operating the LCD panel a number of times over various times and averaging the VCOM shift for each of the time periods over the number of operations, a more accurate estimate of the expected VCOM shift is achieved. This ensures that when such estimate of the expected VCOM shifts are used to dynamically adjust the VCOM levels, the resulting flicker is minimized.

Furthermore, the VCOM shift generator 128 may also measure shifts in the VCOM during these rolling time periods and store the VCOM shift in a table in the embedded controller 122. In one implementation, the VCOM shift generator 128 may repeat such operating of the LCD panel 104 to collect the VCOM shifts over time-periods a predetermined number of times, such as 100 times, and calculate and save the average in persistent memory of the embedded controller 122.

Subsequently, during operation of the LCD panel 104, the embedded controller 122 may adjust the VCOM applied to the LCs based at least in part on the VCOM shifts recorded in such persistent memory. For example, if the VCOM shift over a two-hour period after receiving a power ON signal by the LCD panel is 5 mV/hour, the embedded controller 122 may send instruction to the PMIC 116 to shift the VCOM up by 5 mv during this two-hour window. Similarly, if the VCOM shift over a subsequent is 2.5 mV/hour, the embedded controller 122 may send instruction to the PMIC 116 to shift the VCOM up by 2.5 mv during this four-hour window.

As the embedded controller 122 knows the life cycle of the LCD panel 104 since the last power ON, it manages the VCOM levels based at least in part on the expected VCOM shift as per the rolling time window in which the LCD panel is operating. This results in the VCOM level for the LCD 112 to be set such that for each window, the VCOM level is substantially at the center of voltage applied to the LCD 112 during positive and negative frames. In other word, the delta between the VCOM and the voltage level during the positive frame and the delta between the voltage level at the negative frame is maintained to be substantially the same, resulting in no unintended change in luminance and therefore no flicker for the LCD panel 104.

In one implementation, the embedded controller 122 may communicate with the PMIC 116 using an inter-integrated (I2C) communication bus 130 to communicate the VCOM shifts to be applied to the LCD 112 based at least in part on time windows in the lifecycle of the LCD panel 104 since the last power ON. However, in alternative implementations, other serial communication protocol may be used to communicate between the embedded controller 122 and the PMIC 116.

Figure 2:
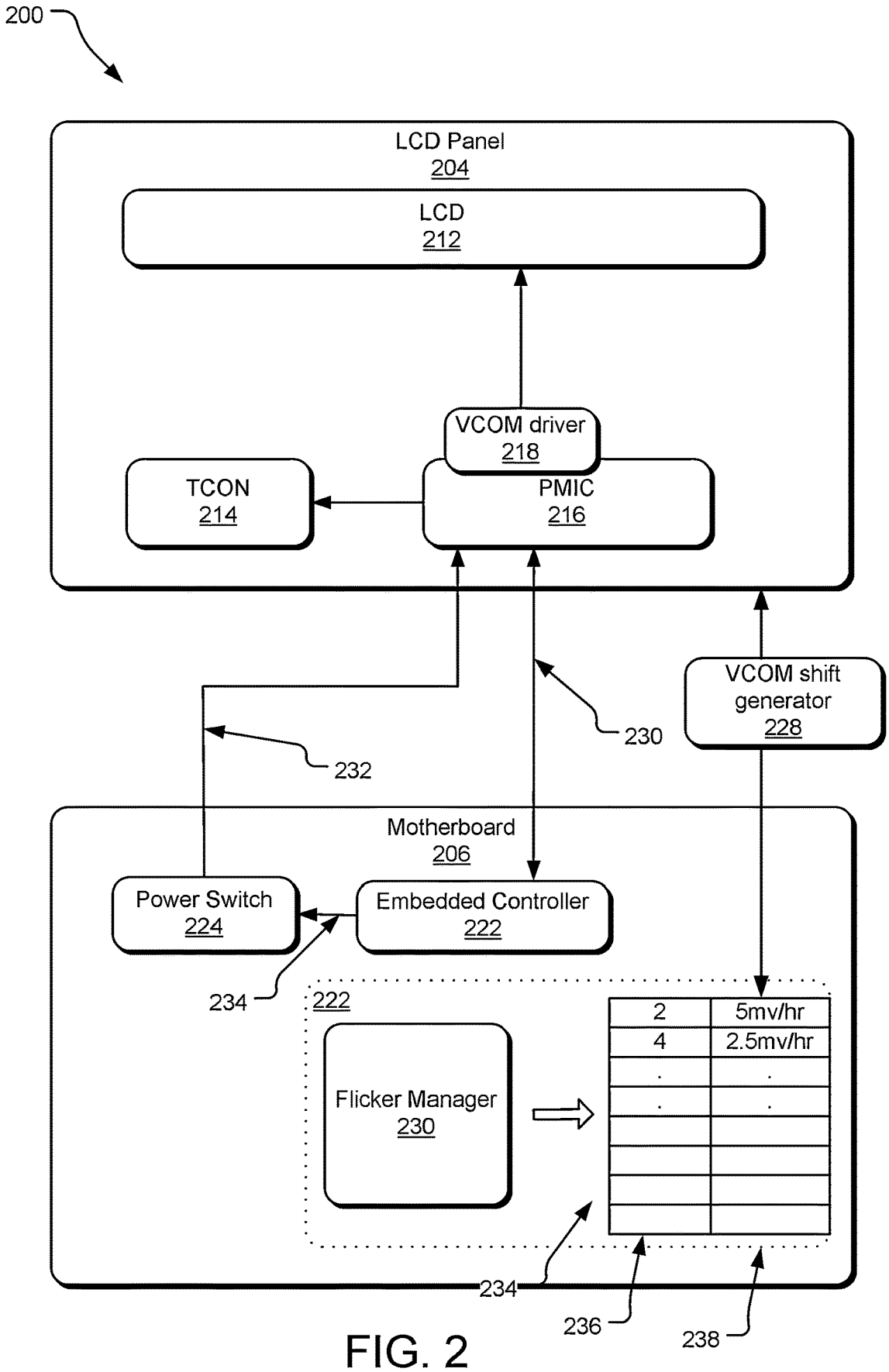
FIG. 2 illustrates an alternative example block diagram of the screen flicker management system disclosed herein.

FIG. 2 illustrates an alternative example block diagram 200 of the screen flicker management system disclosed herein. Specifically, the screen flicker management system disclosed in FIG. 2 includes a motherboard 206 that may be communicatively connected to an LCD panel 204. The motherboard 206 may include, among other components, an embedded controller 222 and a power switch 224. The embedded controller 222 is illustrated to include a flicker manager 230 that manages the flicker on the LCD panel 204 based at least in part on the current stage in the lifecycle of the LCD panel 204. The LCD panel 204 may include, among other components, an LCD 212, a timing controller (TCON) 214, a power management integrated circuit (PMIC) 216, and a VCOM driver 218. In one implementation, the VCOM driver 218 may be integrated in the PMIC 216.

The screen flicker management system 200 also includes a VCOM shift generator 228 that may be implemented using computing instructions executable on a processor. The VCOM shift generator 228 may measure VCOM of the LCs on the LCD 212 over a predetermined time period and records the measured values. For example, the VCOM shift generator 228 may operate the LCD panel for a twenty-four (24) hour on period followed by a six (6) hours of off period and record the VCOM levels of the LCs. The VCOM shift generator 228 may store the measured VCOM levels in local memory and calculate rolling averages for various time-periods, such as rolling a two-hour time period, a rolling four hour time period, a rolling 24-hour time period after power ON as well as various rolling time periods during the off stage. Furthermore, as shown below in FIG. 4, the VCOM shift and its slope changes substantially during various time periods when the LCD panel is on and when it is off. Therefore, operating the LCD panel over both of the on period as well as the off period and measuring the VCOM levels provides a better estimation of the expected VCOM shifts. Using such measured VCOM shifts to adjust the VCOM levels results in higher reduction of flicker during operation of the LCD panel.

Furthermore, the VCOM shift generator 128 may also measure shifts in the VCOM during these rolling time periods and store the VCOM shift in a table in the embedded controller 122. In one implementation, the VCOM shift generator 128 may repeat such operating of the LCD panel 104 to collect the VCOM shifts over time-periods a predetermined number of times, such as 100 times, and calculate and save the average in persistent memory of the embedded controller 122.

In one implementation, the averages of the VCOM shifts for each of the time periods may be stored in a table 234 in the embedded controller 222 where a column 236 designates a time period and the respective adjacent cell in column 238 stores the average VCOM shift for that time period. Thus, as shown, for the time period for the first two hours, the VCOM shift is 5 mv/hr, for the time period of first four hours, the VCOM shift is 2.5 mv/hr, etc.

The embedded controller monitors the power ON signal for the LCD panel 204 in use and in response, communicates via a serial communication bus 230 to the PMIC 216 to change the VCOM level for the LCD 212. In turn, the PMIC 216 may change VCOM reference of a VCOM driver 218 that drives the LCD 212. The switch 224 may be a PMOS or an NMOS switch that turns ON and OFF the system power (3.3. V) to the LCD panel, via PMIC 216.

Figure 3:
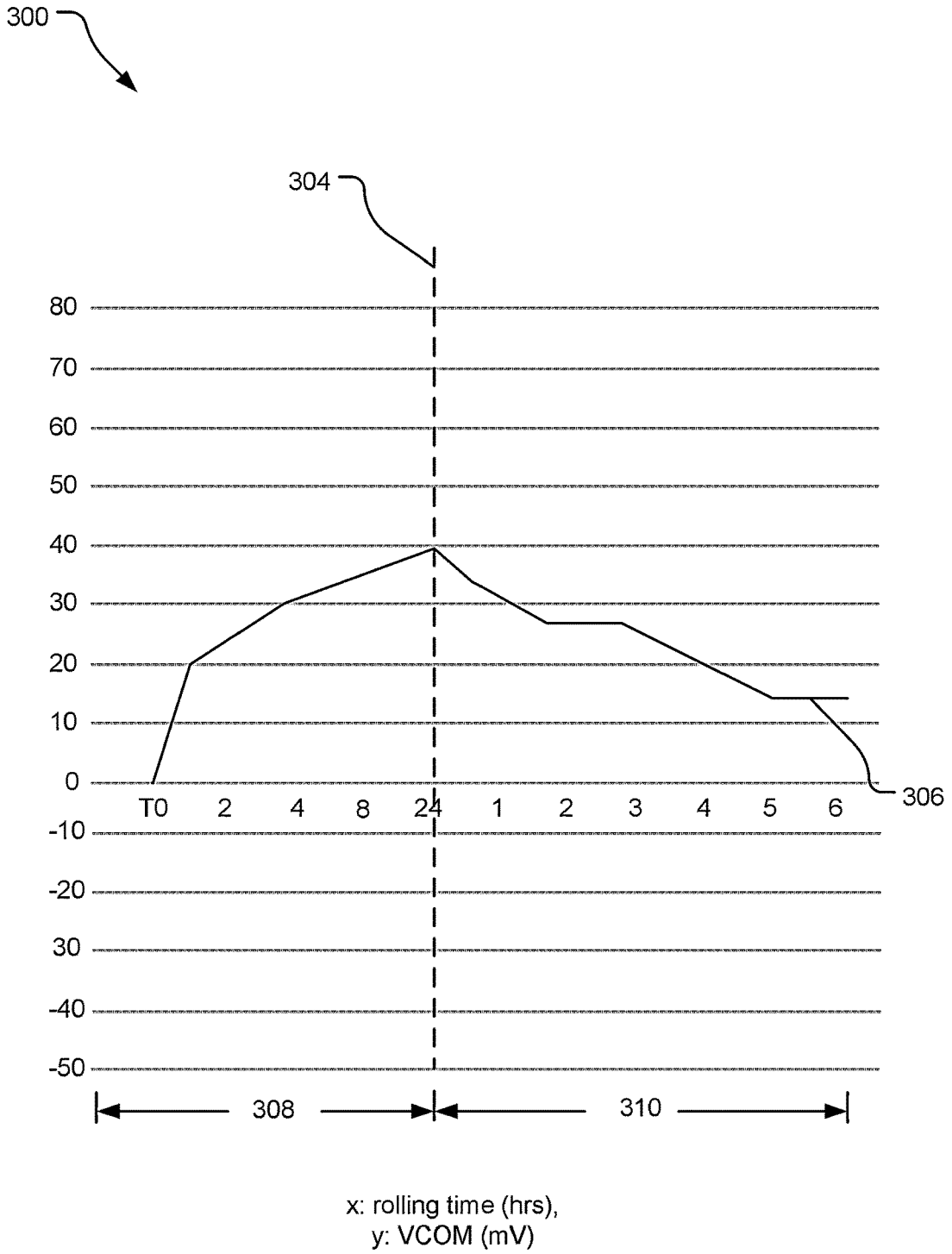
FIG. 3 illustrates an example graph of voltage level shift over time determined and used by the screen flicker management system disclosed herein.

FIG. 3 illustrates an example graph 300 of voltage level shift over time determined and used by the screen flicker management system disclosed herein. Specifically, the graph 300 illustrates VCOM 306 over various time periods from the power ON, which is indicated by T0. For example, the VCOM levels 306 is shown to be shift from 20 mV to 30 mV between 2 hours and 4 hours after T0, indicating a VCOM shift of 5 mv/hr during this time window. Similarly, the VCOM shifts from 30 to 35 mV between 4 hours and 8 hours after T0, indicating a VCOM shift of 5 mv/hr during this time window between 4 hours and 8 hours after T0.

The VCOM levels are collected and stored over a large number of operations of an LCD panel, each time from the power ON period 308 from T0 to power OFF at 304 and a power OFF period 310. These VCOM levels and the related VCOM shifts may be used to linearly adjust VCOM reference levels for a VCOM driver of the LCD display. For example, if the LCD panel is operating in the 4 hour to 8 hours window, where the VCOM shift is 2.5 mV/hr. The reference voltage for the VCOM driver may be shifted by 2.5 mV during this time period. Adjusting the VCOM reference levels of the VCOM driver in a linear manner provides a simple mechanism to calculate the VCOM reference levels based on the measured VCOM shifts and it also results in lower amount of variations in the VCOM reference level. While a non-linear changes in the VCOM reference levels may result in mis-match between the expected VCOM shift and the VCOM reference level adjustments, using linear VCOM shifts provides a better match and therefore, better reduction in the flicker for the LCD panel.

Figure 4:
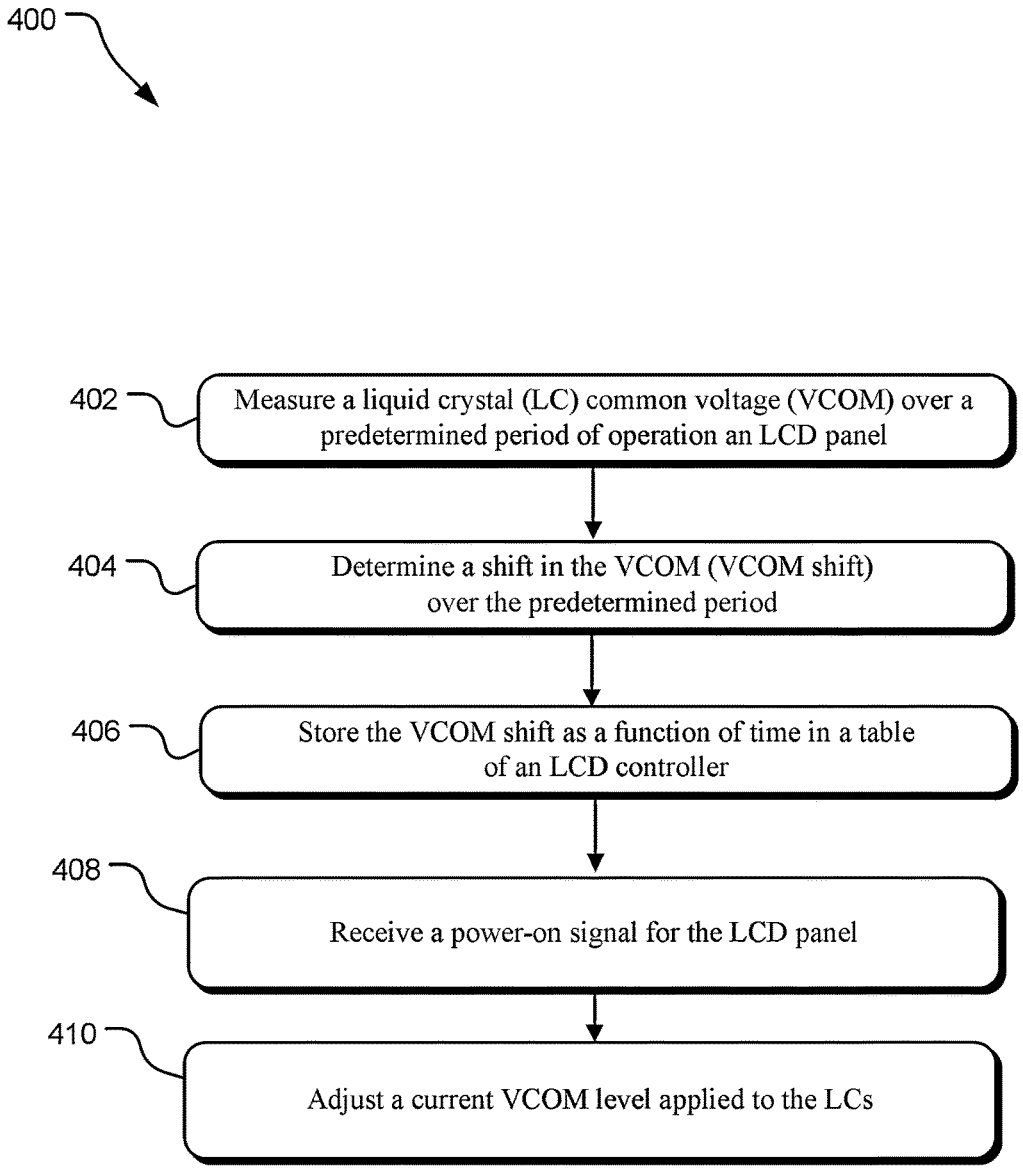
FIG. 4 illustrates example operations of the screen flicker management system disclosed herein.

FIG. 4 illustrates example operations 400 of the screen flicker management system disclosed herein. An operation 402 measures a liquid crystal (LC) common voltage (VCOM) over a predetermined period of operation an LCD panel having a plurality of LCs. For example, the operation 402 may operate an LCD panel for a large number of times and determine an average value of the VCOM at various time-periods after power ON and power OFF. Subsequently, an operation 404 determines a shift in the VCOM (VCOM shift) over the predetermined period based at least in part on the measured VCOM.

Figure 5:
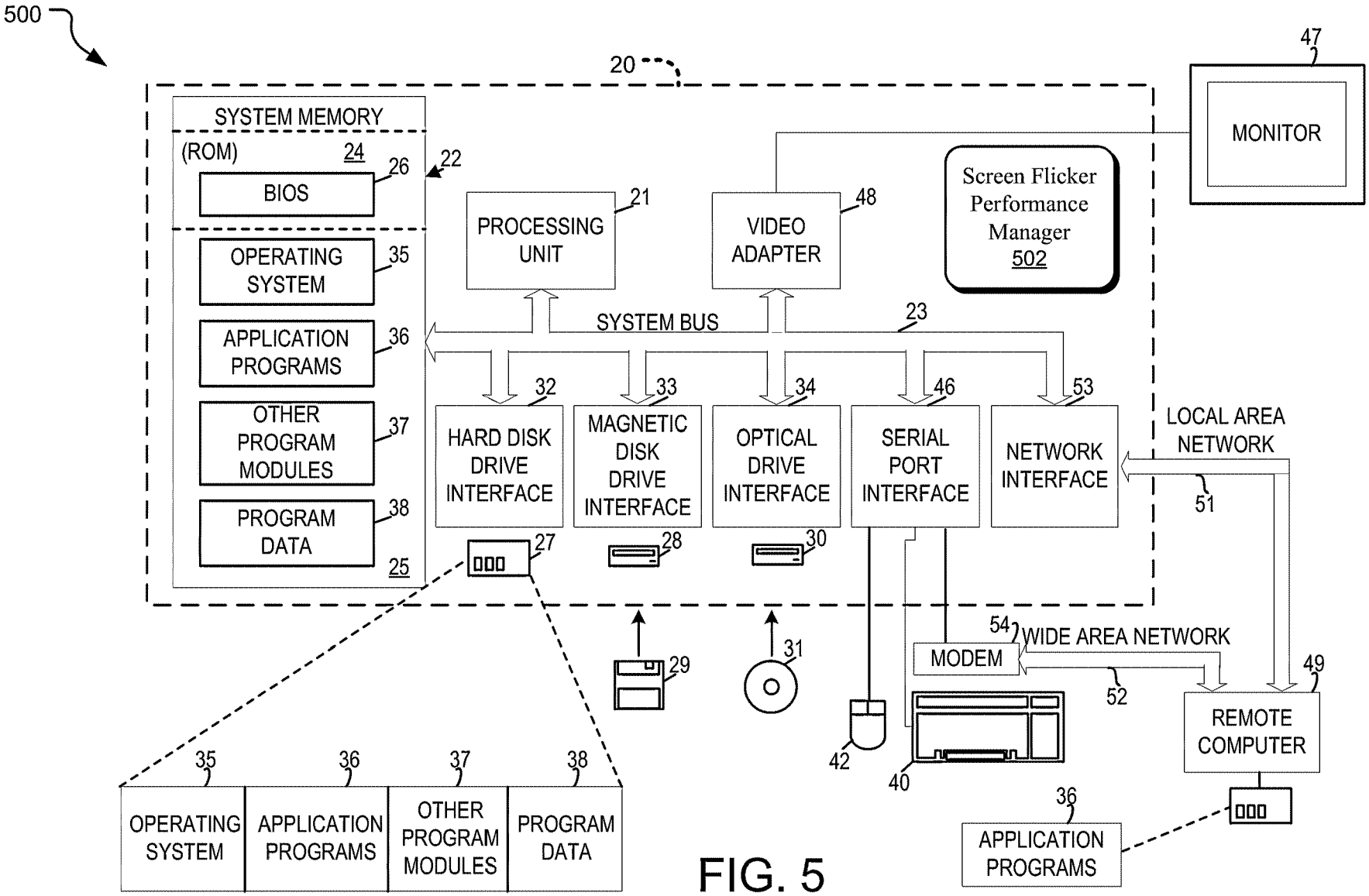
FIG. 5 illustrates an example computing system that may be useful in implementing the described technology.

An operation 406 stores the VCOM shift as a function of time in a table of an embedded controller. The VCOM shifts as a function of time may be used later to set the reference voltage of a VCOM driver of an LCD display. An operation 408 receives a power-on signal for the LCD panel and an operation 410 adjusts a VCOM reference level applied to the LCs based at least in part on the stored values of the VCOM shift FIG. 5 illustrates an example system 500 that may be useful in implementing the device capability model sharing system disclosed herein. The example hardware and operating environment of FIG. 5 for implementing the described technology includes a computing device, such as a general-purpose computing device in the form of a computer 20, a mobile telephone, a personal data assistant (PDA), a tablet, smart watch, gaming remote, or other type of computing device. In the implementation of FIG. 5 for example, the computer 20 includes a processing unit 21, a system memory 22, and a system bus 23 that operatively couples various system components including the system memory to the processing unit 21. There may be only one or there may be more than one processing unit 21, such that the processor of the computer 20 comprises a single central-processing unit (CPU), or a plurality of processing units, commonly referred to as a parallel processing environment. The computer 20 may be a conventional computer, a distributed computer, or any other type of computer; the implementations are not so limited.

The system bus 23 may be any of several types of bus structures including a memory bus or memory controller, a peripheral bus, a switched fabric, point-to-point connections, and a local bus using any of a variety of bus architectures. The system memory may also be referred to as simply the memory, and includes read only memory (ROM) 24 and random access memory (RAM) 25. A basic input/output system (BIOS) 26, containing the basic routines that help to transfer information between elements within the computer 20, such as during start-up, is stored in ROM 24. The computer 20 further includes a hard disk drive 27 for reading from and writing to a hard disk, not shown, a magnetic disk drive 28 for reading from or writing to a removable magnetic disk 29, and an optical disk drive 30 for reading from or writing to a removable optical disk 31 such as a CD ROM, DVD, or other optical media.

The hard disk drive 27, magnetic disk drive 28, and optical disk drive 30 are connected to the system bus 23 by a hard disk drive interface 32, a magnetic disk drive interface 33, and an optical disk drive interface 34, respectively.

The drives and their associated tangible computer-readable media provide non-volatile storage of computer-readable instructions, data structures, program modules and other data for the computer 20. It should be appreciated by those skilled in the art that any type of tangible computer-readable media may be used in the example operating environment.

A number of program modules may be stored on the hard disk drive 27, magnetic disk 28, optical disk 30, ROM 24, or RAM 25, including an operating system 35, one or more application programs 36, other program modules 37, and program data 38. A user may generate reminders on the personal computer 20 through input devices such as a keyboard 40 and pointing device 42. Other input devices (not shown) may include a microphone (e.g., for voice input), a camera (e.g., for a natural user interface (NUI)), a joystick, a game pad, a satellite dish, a scanner, or the like. These and other input devices are often connected to the processing unit 21 through a serial port interface 46 that is coupled to the system bus 23, but may be connected by other interfaces, such as a parallel port, game port, or a universal serial bus (USB) (not shown). A monitor 47 or other type of display device is also connected to the system bus 23 via an interface, such as a video adapter 48. In addition to the monitor, computers typically include other peripheral output devices (not shown), such as speakers and printers.

The computer 20 may operate in a networked environment using logical connections to one or more remote computers, such as remote computer 49. These logical connections are achieved by a communication device coupled to or a part of the computer 20; the implementations are not limited to a particular type of communications device. The remote computer 49 may be another computer, a server, a router, a network PC, a client, a peer device or other common network node, and typically includes many or all of the elements described above relative to the computer 20. The logical connections depicted in FIG. 10 include a local-area network (LAN) 51 and a wide-area network (WAN) 52. Such networking environments are commonplace in office networks, enterprise-wide computer networks, intranets and the Internet, which are all types of networks.

When used in a LAN-networking environment, the computer 20 is connected to the local network 51 through a network interface or adapter 53, which is one type of communications device. When used in a WAN-networking environment, the computer 20 typically includes a modem 54, a network adapter, a type of communications device, or any other type of communications device for establishing communications over the wide area network 52. The modem 54, which may be internal or external, is connected to the system bus 23 via the serial port interface 46. In a networked environment, program engines depicted relative to the personal computer 20, or portions thereof, may be stored in the remote memory storage device. It is appreciated that the network connections shown are examples and other means of communications devices for establishing a communications link between the computers may be used.

In an example implementation, software or firmware instructions for a device capability model sharing system may be stored in memory 22 and/or storage devices 29 or 31 and processed by the processing unit 21. One or more ML, NLP, or DLP models disclosed herein may be stored in memory 22 and/or storage devices 29 or 31 as persistent datastores. For example, a screen flicker management system 502 may be implemented on the computer 20 as an application program 36 (alternatively, the screen flicker management system 502 may be implemented on a server or in a cloud environment). The screen flicker management system 502 may utilize one of more of the processing unit 21, the memory 22, the system bus 23, and other components of the personal computer 20.

In contrast to tangible computer-readable storage media, intangible computer-readable communication signals may embody computer readable instructions, data structures, program modules or other data resident in a modulated data signal, such as a carrier wave or other signal transport mechanism. On the other hand, tangible computer-readable storage media may not embody only computer readable instructions, data structures, program modules or other data resident in a modulated data signal, such as a carrier wave or other signal transport mechanism. The term "modulated data signal" means a signal that has one or more of its characteristics set or changed in such a manner as to encode information in the signal. By way of example, and not limitation, intangible communication signals include wired media such as a wired network or direct-wired connection, and wireless media such as acoustic, RF, infrared and other wireless media.

A physical article of manufacture disclosed herein includes one or more tangible computer-readable storage media, storing computer-executable instructions for executing on a computer system a computer process, the computer process including measuring a liquid crystal (LC) common voltage (VCOM) over a predetermined period of operation an LCD panel having a plurality of LCs, determining a shift in the VCOM (VCOM shift) over the predetermined period based at least in part on the measured VCOM, storing the VCOM shift as a function of time in a table of an embedded controller, receiving a power-on signal for the LCD panel, and adjusting a VCOM reference level applied to the LCs based at least in part on the stored values of the VCOM shift.

A method disclosed herein includes measuring a liquid crystal (LC) common voltage (VCOM) over a predetermined period of operation an LCD panel having a plurality of LCs, determining a shift in the VCOM (VCOM shift) over the predetermined period based at least in part on the measured VCOM, storing the VCOM shift as a function of time in a table of an embedded controller, receiving a power-on signal for the LCD panel, and adjusting a VCOM reference level applied to the LCs based at least in part on the stored values of the VCOM shift.

A system disclosed herein includes memory, one or more processor units, an LCD display including a VCOM driver configured to provide reference voltage to a plurality of LCs, a VCOM shift generator, and a flicker management system. The VCOM shift generator stores computer-executable instructions on the memory for executing on the one or more processor units a computer process, the computer process including measuring a liquid crystal (LC) common voltage (VCOM) over a predetermined period of operation the LCD panel, determining a shift in the VCOM (VCOM shift) over the predetermined period based at least in part on the measured VCO, and storing the VCOM shift as a function of time in a table of an embedded controller. The flicker management system stores computer-executable instructions on the memory for executing on the one or more processor units a computer process, the computer process including receiving a power-on signal for the LCD panel, and adjusting a VCOM reference level applied to the LCs based at least in part on the stored values of the VCOM shift.

The implementations described herein are implemented as logical steps in one or more computer systems. The logical operations may be implemented (1) as a sequence of processor-implemented steps executing in one or more computer systems and (2) as interconnected machine or circuit modules within one or more computer systems. The implementation is a matter of choice, dependent on the performance requirements of the computer system being utilized. Accordingly, the logical operations making up the implementations described herein are referred to variously as operations, steps, objects, or modules. Furthermore, it should be understood that logical operations may be performed in any order, unless explicitly claimed otherwise or a specific order is inherently necessitated by the claim language.

The above specification, examples, and data provide a complete description of the structure and use of exemplary embodiments of the invention. Since many implementations of the invention can be made without departing from the spirit and scope of the invention, the invention resides in the claims hereinafter appended. Furthermore, structural features of the different embodiments may be combined in yet another implementation without departing from the recited claims.

What is claimed is:

1. A physical article of manufacture including one or more non-transitory computer-readable storage media, storing computer-executable instructions for executing on a computer system a computer process, the computer process comprising:

measuring a liquid crystal (LC) common voltage (VCOM) over a predetermined period of operation of an LCD panel having a plurality of LCs;

determining a shift in the VCOM (VCOM shift) over the predetermined period based at least in part on the measured VCOM;

storing the VCOM shift as a function of time in a table of an embedded controller;

receiving a power-on signal for the LCD panel after the storing; and adjusting, responsive to the receiving, a VCOM reference level applied to the LCs based at least in part on the stored values of the VCOM shift to maintain the VCOM of the LCD panel at a level relative to a voltage level during a positive frame and a voltage level during a negative frame.

2. The physical article of manufacture of claim 1, wherein adjusting the VCOM reference level further comprises adjusting the VCOM level reference based at least in part on time elapsed since receiving the power-on signal.

3. The physical article of manufacture of claim 1, wherein measuring the VCOM further comprises operating the LCD panel for the predetermined period for a plurality of times and measuring the VCOM values as a function of time for each operation of the LCD panel.

4. The physical article of manufacture of claim 3, wherein adjusting the VCOM reference level further comprises averaging the VCOM values as a function of time for the plurality of operations of the LCD panel.

5. The physical article of manufacture of claim 1, wherein adjusting the VCOM reference level further comprises communicating a VCOM adjustment to the LCD panel via a serial communication bus.

6. The physical article of manufacture of claim 1, wherein the predetermined period of operation includes at least an on-period with LCD display being on and an off-period with the LCD display being turned off.

7. The physical article of manufacture of claim 6, wherein the on-period includes a static on period with the LCD display displaying a static image and a non-static on period with the LCD display displaying a non-static image.

8. The physical article of manufacture of claim 1, wherein adjusting the VCOM reference level further comprises increasing the VCOM reference level linearly by a predetermined mV per hour upon receiving the power-on signal.

9. The physical article of manufacture of claim 8, wherein adjusting the VCOM reference level further comprises increasing the VCOM reference level linearly by a 5 mV per hour for first four hours upon receiving the power-on signal.

10. A method, comprising:

measuring a liquid crystal (LC) common voltage (VCOM) over a predetermined period of operation an LCD panel having a plurality of LCs;

determining a shift in the VCOM (VCOM shift) over the predetermined period based at least in part on the measured VCOM;

storing the VCOM shift as a function of time in a table of an embedded controller;

receiving a power-on signal for the LCD panel after the storing; and adjusting, responsive to the receiving, a VCOM reference level applied to the LCs based at least in part on the stored values of the VCOM shift to substantially maintain the VCOM of the LCD panel at a level relative to a voltage level during a positive frame and a voltage level during a negative frame.

11. The method of claim 10, wherein adjusting the VCOM reference level further comprises adjusting the VCOM reference level based at least in part on time elapsed since receiving the power-on signal.

12. The method of claim 10, wherein measuring the VCOM further comprises operating the LCD panel for the predetermined period for a plurality of times and measuring the VCOM values as a function of time for each operation of the LCD panel.

13. The method of claim 12, wherein adjusting the VCOM reference level further comprises averaging the VCOM values as a function of time for the plurality of operations of the LCD panel.

14. The method of claim 10, wherein adjusting the VCOM reference level further comprises communicating a VCOM adjustment to the LCD panel via a serial communication bus.

15. The method of claim 10, wherein the predetermined period of operation includes at least an on-period with LCD display being on and an off-period with the LCD display being turned off.

16. A system, comprising:

one or more non-transitory computer-readable storage media;

one or more processor units;

an LCD display including a VCOM driver configured to provide reference voltage to a plurality of LCs;

a VCOM shift generator storing computer-executable instructions on the one or more non-transitory computer-readable storage media for executing on the one or more processor units a computer process, the computer process comprising:

measuring a liquid crystal (LC) common voltage (VCOM) over a predetermined period of operation the LCD panel, determining a shift in the VCOM (VCOM shift) over the predetermined period based at least in part on the measured VCOM, and storing the VCOM shift as a function of time in a table of an embedded controller, and a flicker management system storing computer-executable instructions on the memory for executing on the one or more processor units a computer process, the computer process comprising:

receiving a power-on signal for the LCD panel after the storing, and adjusting, responsive to the receiving, a VCOM reference level applied to the LCs based at least in part on the stored values of the VCOM shift to maintain the VCOM of the LCD panel at a level relative to a voltage level during a positive frame and a voltage level during a negative frame.

17. The system of claim 16, wherein adjusting the VCOM reference level further comprises adjusting the VCOM level reference based at least in part on time elapsed since receiving the power-on signal.

18. The system of claim 16, wherein measuring the VCOM further comprises operating the LCD panel for the predetermined period for a plurality of times and measuring the VCOM values as a function of time for each operation of the LCD panel.

19. The system of claim 16, wherein adjusting a VCOM reference level further comprises averaging the VCOM values as a function of time for the plurality of operations of the LCD panel.

* * * * *